United States Patent [19]

Bergoltz

[11] 4,359,619

[45] Nov. 16, 1982

[54] COVER FOR A BOX OF ELECTRIC CONTACTS SUCH AS SWITCHES, PUSH BUTTON, SOCKETS AND THE LIKE

[76] Inventor: Anatolio Bergoltz, 4969 Osorio St., Buenos Aires, Argentina

[21] Appl. No.: 254,477

[22] Filed: Apr. 15, 1981

Related U.S. Application Data

[63] Continuation of Ser. No. 63,038, Aug. 2, 1979, abandoned.

[30] Foreign Application Priority Data

Aug. 11, 1978 [AR] Argentina ..... 273292

[51] Int. Cl.[3] ..... H01H 13/04

[52] U.S. Cl. ..... 200/333; 174/66; 220/241

[58] Field of Search ..... 174/66, 67; 200/302, 200/304, 329, 330, 333, 334, 155 A, 293, 297; 220/241, 242

[56] References Cited

U.S. PATENT DOCUMENTS

| | | | |
|---|---|---|---|
| 2,515,932 | 7/1950 | Stang et al. | 200/330 |
| 2,740,873 | 4/1956 | Cronk | 174/66 |
| 2,794,890 | 6/1957 | Taylor | 200/330 |
| 3,036,185 | 5/1962 | Wiley et al. | 200/330 |
| 3,437,737 | 4/1969 | Wagner | 174/66 |
| 3,437,738 | 4/1969 | Wagner | 174/66 |

FOREIGN PATENT DOCUMENTS

| | | | |
|---|---|---|---|
| 1173962 | 7/1964 | Fed. Rep. of Germany | 200/330 |

*Primary Examiner*—John W. Shepperd

*Attorney, Agent, or Firm*—LeBlanc, Nolan, Shur & Nies

[57] ABSTRACT

For use in combination with a box-type receptable containing electrical contacts such as switch contacts or a socket, a first cover comprising a planar frame on which the cover is removably mounted, the frame defining an access opening, a pair of fixed spaced headboards extending across the frame, the headboards being at opposite ends of the opening and having their outer surfaces lying substantially in a plane that is disposed slightly outwardly from the plane of the frame and defining between them a space that extends over the access opening and transversely entirely across the frame, a complementary cover mounted in and occupying that space, the complementary cover substantially entirely filling the space and extending transversely entirely across the space and having on opposite end edges sliding fit with the headboards, with the outer surface of the complementary cover substantially coplanar with the outer surfaces of the headboards, and pins on the inner side of the complementary cover coacting with recesses on the frame for removably attaching the complementary cover to the first cover to overlie the cover opening.

12 Claims, 17 Drawing Figures

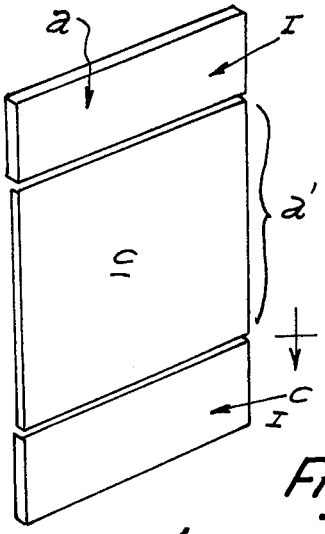
Fig.1
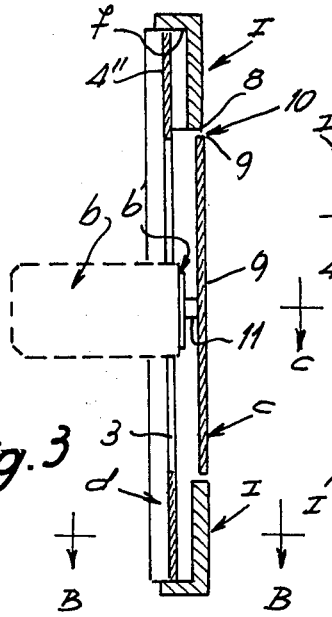
Fig.3
Fig.4
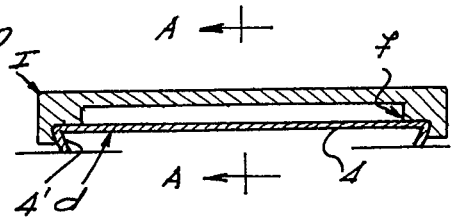
Fig.5
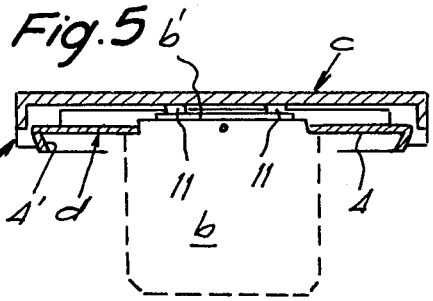
Fig.6
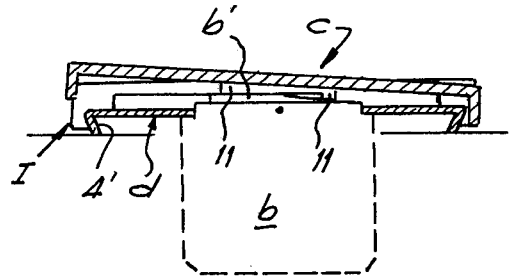
Fig.2
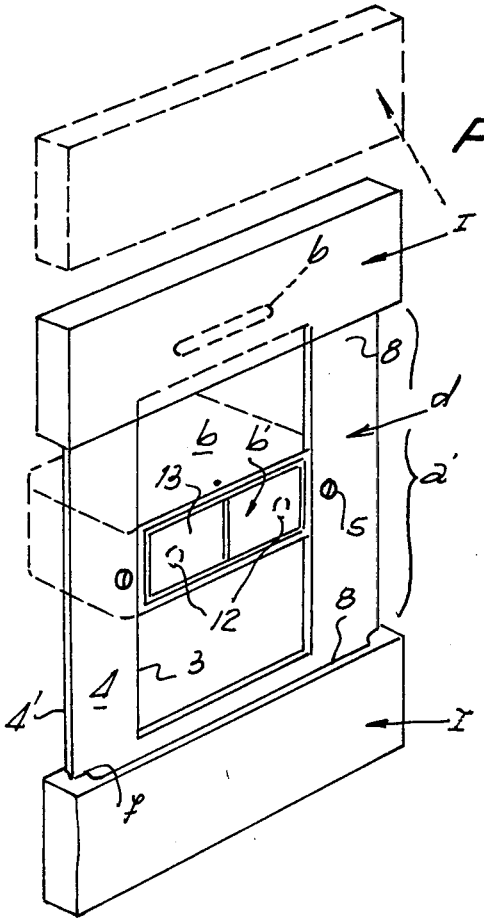
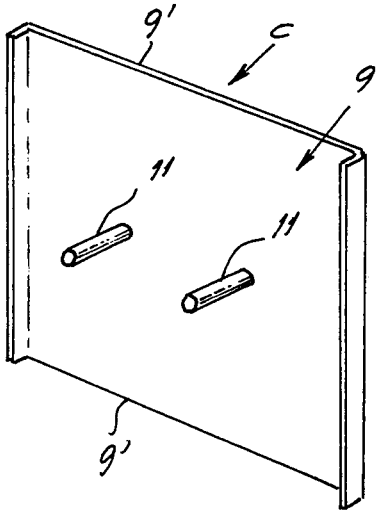

Fig.7
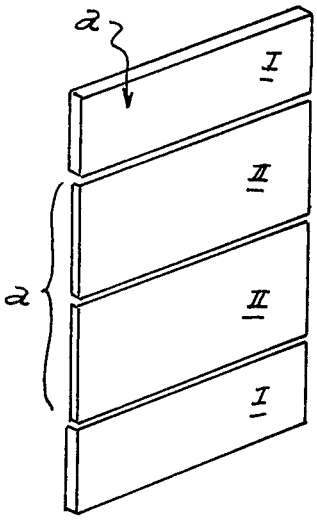
Fig.9
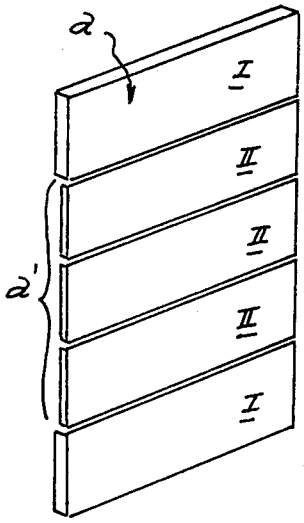
Fig.8
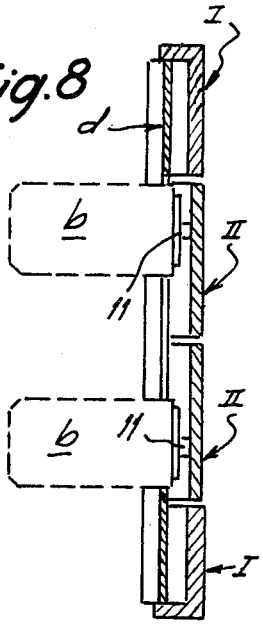
Fig.11
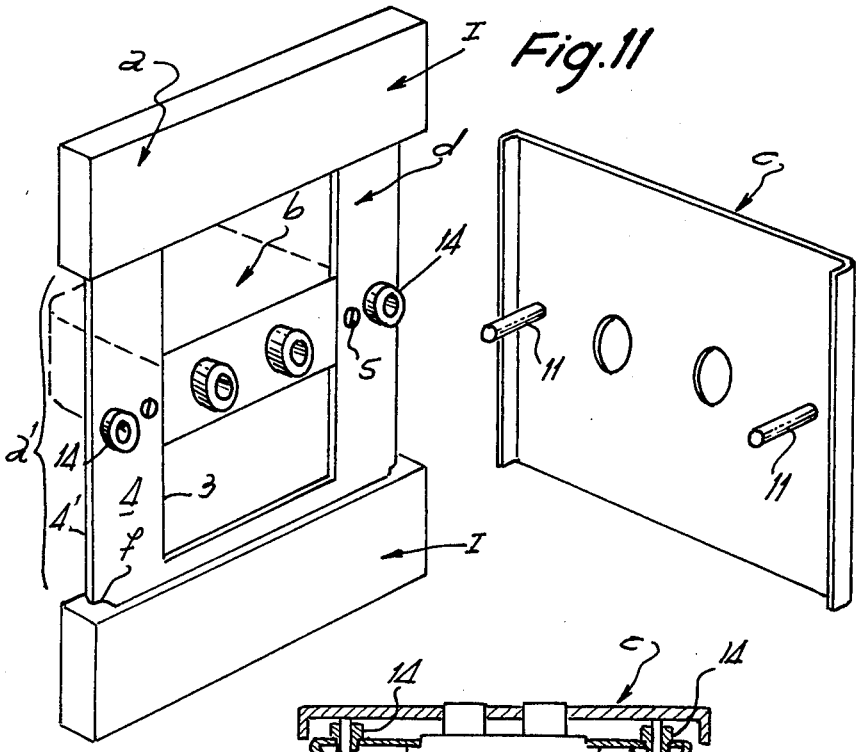
Fig.10
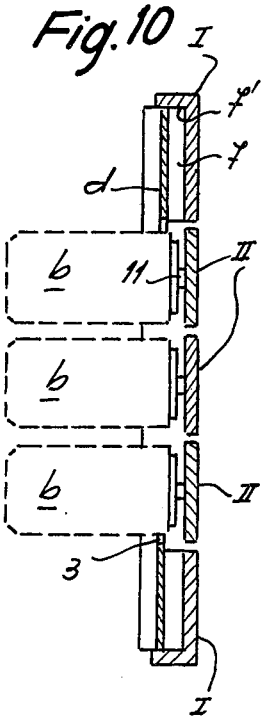
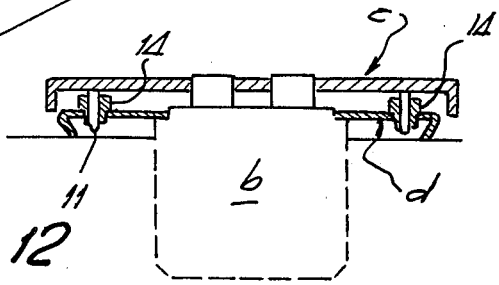
Fig.12

COVER FOR A BOX OF ELECTRIC CONTACTS SUCH AS SWITCHES, PUSH BUTTON, SOCKETS AND THE LIKE

This is a continuation of application Ser. No. 63,038, filed Aug. 2, 1979 now abandoned.

This invention concerns a cover for a box of electric contacts such as switches, push buttons, sockets, and the like, of the type consisting of a cover proper which is removably in contact with the box and has an opening for the part of the mechanism by which electrical contact is activated in the case of a switch, push button and the like, and the application of a complementary connector in the case of an uncovered socket, it providing in connection with the foregoing a complementary cover which in the case of a switch, push button and the like is directly connected to the part which activates the corresponding movable contact and in the case of a socket is joined to one of the elements of the cover-body of the socket and provides access to the socket holes.

Covers of this type have a particular defect due to the fact that the complementary cover which goes over the opening of the cover proper protrudes appreciably from the latter which not only causes it to frequently be activated inadvertently in the case of a switch or a push button, especially because of the little effort this requires, but also because, whatever its application, it easily becomes hooked to clothes of people rubbing against it, or to curtains in its vicinity, etc., which often deteriorates them and also in many cases causes the complementary cover to become separated from the switch, push button or socket to which it is joined, and the breakage of it or the joining elements.

Because of the above, the principle and basic purpose of this invention is to achieve a cover structure of this type in which the complementary cover, in any of its applications, i.e. either as a switch, a push button or the like or when simply providing access to the holes of the socket, is practically on the same plane as the rest of the cover itself, so that it does not protrude from it in a manner that can cause the above defects, but all of this is such a way that it does not affect its functioning as a socket nor calls for any modifications to the switch or push button nor to the manner of joining the latter to the body.

This fundamental purpose has been achieved in a practical manner with the cover to which this invention refers, which developed on the basis of a unit of the above type is characterised in its essential shape and aspect because the aforementioned opening extends throughout the whole of the width of the cover, from one side to the other, in the form of a wide strip which divides the cover into two end portions like headboards which are joined by a common frame which has its own opening to leave uncovered the maximum numbers of units that can be housed by the cover, the corresponding complementary cover provided in relation to the aforementioned opening of the cover consisting of a plaque which fits between the edges of the headboard sectors, substantially on a same plane with them, completely filling the space between them both down and across, and establishing a thin sliding joint between its own edges and the respective adjacent edges of the headboards.

To facilitate the understanding of this invention and for its greater clarity, the cover of the invention has been illustrated in several figures according to some of the more preferred forms of making it, all merely as examples.

FIG. 1 is a perspective view showing a switch cover.

FIG. 2 is an exploded enlarged view showing detail of the cover of FIG. 1.

FIG. 3 is an end view partly in section on line A—A of FIG. 4.

FIG. 4 is a transverse section on line B—B of FIG. 3.

FIG. 5 is a lateral section on line C—C of FIG. 3.

FIG. 6 is similar to FIG. 5 but with the complementary cover shown displaced when functioning as a switch.

FIGS. 7 and 8 are similar to FIGS. 1 and 3 respectively, but showing the cover as applied to two switches.

FIGS. 9 and 10 are similar to FIGS. 1 and 3 respectively, but showing the cover as applied to three switches.

FIGS. 11 and 12 are similar to FIGS. 2 and 5 respectively, but showing the cover as applied to a socket.

In the various figures the same numerals indicate the same or corresponding parts or elements.

Figure 13:
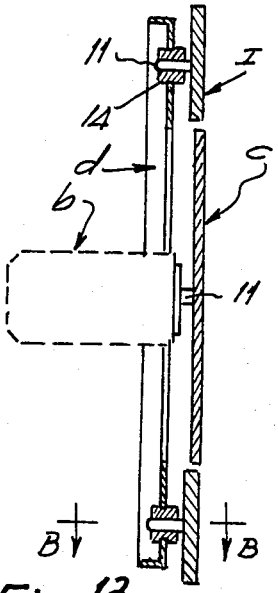
FIGS. 13 and 14 are similar to FIGS. 3 and 4 respectively, but showing a different manner of affixing the headboards of the cover.

As explained above and illustrated in the aforementioned drawings, the cover of the invention for a box of electric contacts such as switches, push buttons, sockets and the like, has been developed on the basis of an arrangement which, according to its basic general outline, consists of a cover proper a which is removably joined to the box as per any of the technical devised means and includes an opening a' which leaves uncovered the part b' of the component by by means of which it is put into action in the case of a switch, push button and the like, or a complementary connector is applied, of the plug type, in the case of a socket.

In relation to this uncovered part of the component, a complementary cover c is provided which in the case of a switch, push button and the like, is directly joined to the referred part b' and by means of which the respective movable contact element is actuated, and in the case of a socket is joined to one of the two elements of the otherwise closed body of the socket and is provided with accesses 1 to the respective contact holes 2 of the socket.

According to this invention the aforementioned opening a' of the cover proper a has the particularity that it extends across the whole width of the latter from one edge to the other, in the form of a wide band that separates the cover into two end portions I in the form of headboards, which are joined by a common frame d which is provided with its own opening 3 which leaves uncovered the aforementioned part b' of the maximum number of contact devices b that the box can house.

The aforementioned contact devices b are mounted within the box by means of a conventional frame attached to the usual fastening gadgets provided in the box, generally in the shape of ears projected inwardly from opposite edges of its opening, and on this frame the cover proper a is affixed by means of its own frame d, to which are joined the end headboard portions I, it being possible within the scope of this invention to dispense with the aforementioned conventional frame specifically used for mounting the devices and to affix them directly on to the aforementioned frame d of the cover as by screws 5, which thus becomes a double frame, and is affixed directly on to the aforementioned fastening ears, this being the preferred manner to which reference is made in the subsequent drawings and description of the proposed example to be carried out.

The frame d consists of a laminar part 4 substantially plane, of sufficient width to completely cover the opening of the box and is provided, on at least two opposite sides, with narrow flanges 4' which protrudes rearward on the side which is to face the opening of the box, these sides corresponding to the edges of the cover proper a between which the aforementioned opening a' extends, in the form of a band which divides the aforementioned end headboards I in two.

These flanges 4' provide, through their respective edges, the seat by which this frame d or, more accurately, the joint frame and cover proper, is affixed to the wall into which the box is embedded, and they have the particularity, in this example, that they are bent at an angle of less than ninety degrees with respect to the back face, in such a manner that both the ends 4'' of the frame holding the aforementioned headboards I have a tapezoidal cross section as can be seen in FIGS. 4 and 5.

The aforementioned laminar part 4 of the frame d is provided, apart from the central opening 3, equivalent to the opening of the conventional frame, on whose marginal ends the contact devices are to be affixed as per any of the normal technical systems (simple screws in this case), with through holes 6 for screws for affixing it to the fastening ears of the box.

In this example, both end or headboard parts I of the cover proper a consist of two pieces cast in, for example, plastic, each of which has an inlaid fitting 7 of a cross section similar to the aforementioned virtually trapezoidal cross section of the respective end part 4'' of the frame, by means of which each of the headboards is fitted onto one of these end parts and is held there by friction, specially if the fitting is done with a certain degree of tightness and the material of the headboard has a slight degree of elasticity.

The fitting 7 of the headboard I has a back plate 7' which by butting against the edge of the end part 4'' of the frame on which it is applied, limits the aforementioned fitting and determines the correct position of the headboard on which both are equidistant from the center of the frame, there being between their respective facing borders 8 a separation which coinciding with the aforementioned opening a' of the cover, leaves uncovered the central opening proper 3 of the frame.

The aforementioned complementary cover c which in the form of a band entirely covers the opening a' of the cover proper a which it divides into the two headboards I, consists of a plaque 9 which fits between the two borders 8 of the headboards, in a position substantially on a plane with them, entirely filling both lengthwise and crosswise the separation between the two headboards and establishing a narrow sliding joint line 10 between its own edges 9' and the respective adjacent edges 8 of the headboards, in such a manner that this plaque can be easily fitted between the two headboards when the latter are installed in their definite position.

This complementary cover-plaque c provides a virtual solution of continuity between the headboard parts I and has no protrusion which could give rise to the problems mentioned above.

When the contact unit b at to the frame d is a switch, push button or the like, the aforementioned complementary plaque-cover c is affixed to the part b', by means of which the corresponding movable contact is activated, through a couple of spikes 11 which protrude from the rear face and are inserted tightly in perforations 12 which are provided in the unit, generally consisting of a small balance beam 13 in the case of a switch and by a sliding block in the case of a push button, all of which can be seen in FIGS. 2, 3 and 5.

When the unit is a socket (see FIGS. 11 and 12) the complementary plaque-cover c is also affixed by a couple of spikes 11 which protrude from the hind face and can be inserted in corresponding perforations provided in the body of the unity attached to the frame or to the unit itself, indistinctly, it being on the frame in the illustrated example.

In the cases in which the spikes are inserted in the frame d, specially when the frame consists of a laminar plate of a proportionally small thickness, the unit is provided, instead of with simple perforations which could give rise to the stripping of the spikes, with fittings preferentially with a certain degree of elasticity, consisting of bushings 14 fitted in perforations in the frame to which they are affixed by respective rims on each side of the bushings which protrude on either side of the frame as shown in detail in FIG. 11.

As can be easily seen, the affixing of the aforementioned complementary plaque-cover c, both in the case of a switch as of a push button, in which the plaque-cover is movable for the purpose of producing the displacement of the corresponding contact element of the unit, is effected to the aforementioned part b' of the unit in such a manner that in the position of opening the switch, push button or the like, it remains on a perfect plane with the headboard parts I, with its outer face practically on a level with the latter, and displaced in relation to them only when moving the aforementioned contact element to its closing position, when, in the case of a switch, it remains slightly oblique in relation to the two sectors (see FIG. 6), while in the case of a push button it remains on a lower level as long as the pressure on it to keep the aforementioned contact element in a closed position is maintained.

In the case that two contact units are affixed to the frame d, the complementary plaque-cover c is divided into two equal sections or segments II each of which takes up half of the separation between the two headboards parts I and all the width of the cover, i.e. of the opening a' of the cover, and is affixed to the corresponding part b' of the respective contact unit b completely independently from the other section or segment (FIGS. 7 and 8).

In the case where three contact units b are affixed, the complementary plaque-cover is divided into three sections or segments II as those previously mentioned, each one of which will take up a third of the separation between the two headboard parts I and all the width of the cover, and are affixed to the corresponding part b' of the respective unit completely independently from the other sections or segments (FIGS. 9 and 10).

In all cases affixing is effected by means of the aforementioned spikes 11 and the corresponding insertion perforation-sockets for them.

As regards affixing it should be pointed out that the use of spike sockets is not limitative end that any other existing technical system or any other that might be developed in future to achieve the same ends can be used.

Figure 14:
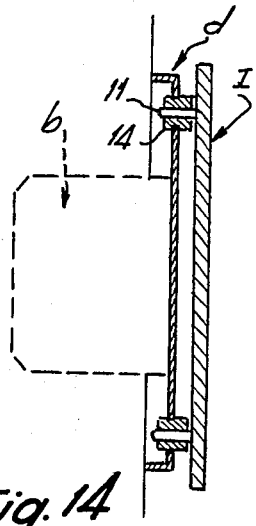

Regarding the affixing of the aforementioned end parts or headboards I of the cover proper a, an alternative to the illustrated and described placing has been developed, it consisting of using the same combination of spikes 11 and fittings provided for affixing the complementary cover c in the case where it is to operate with a socket (FIGS. 11 and 12) and consequently each of the headboards have two spikes 11 extending from the rear face and are inserted into fittings provided on the frame d of the cover, preferably consisting of the aforementioned bushings 14, all of which is illustrated in FIGS. 13 and 14.

When the cover is specifically desgined to be provided with one sole contact unit, the separation between the headboards I can be smaller than in the illustrated example and, therefore, the headboards can be bigger and thus be extended to cover part of the upper and lower areas of the aforementioned central opening 3 of the frame, and leaving the opening a' of the cover proper a reduced to a much narrower band but always extending from one edge to the other, i.e. taking up the full width of the frame; in this case the separation between the two headboards can be a third of that provided for when it is destined to accomodate the maximum number of contact units, thus allowing the use of a complementary cover of a size equal to that of the section or segment used for each contact unit in the case of three, as shown in FIG. 10.

Within the scope of this invention also is contemplated that instead of using a special plaque-cover c in the case of one contact unit, and the same plaque-cover divided in two, in the case of two units, to provide for each of them a section or segment II as in the case of three units, i.e. of a width equal to one third of the separation between each of the headboards I and to fill the part of the opening a' of the cover proper that remains uncovered with two equal sections or segments, this in case of one sole unit, and with one section or segment in the case of two units.

These sections of segments II are affixed directly on to the frame in the same manner provided for the headboards in the example of FIGS. 1 and 4, i.e. by giving them a trapezoidal section fitting to allow them to be slipped on to the frame d from one of its ends 4" before the headboards are put in, or by means of the aforementioned spikes 11 on the sections or segments II and fittings on the frame, as provided for affixing the complementary cover c when the contact unit is a socket (FIGS. 11 and 12) using as fittings on the frame the aforementioned bushings 14.

Figure 15:
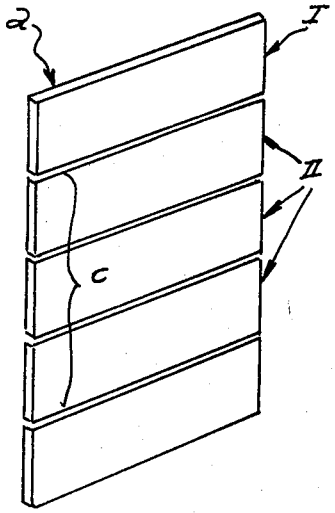
FIGS. 15, 16 and 17 are similar to FIGS. 1, 2 and 3 respectively but showing another form of the cover.
Figure 17:
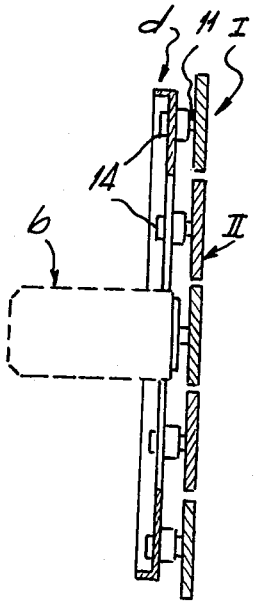
Figure 16:
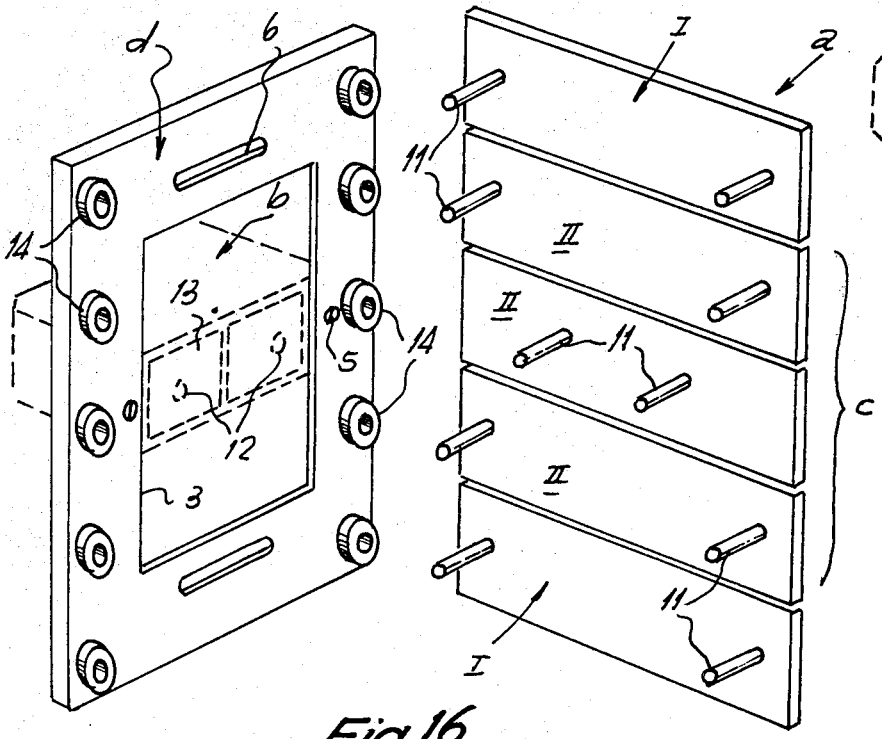

Another alternative also included within the scope of this invention, consists of a combination of the previous alternatives, resulting in a cover as shown in FIGS. 15, 16 and 17, in which the cover is composed of end headboards parts I and a complementary cover c which in its turn comprises three independent sections II, which, according to the units installed, shall be affixed to them or to the frame, while the headboards shall always be affixed to the frame.

The affixing of these headboard parts I and intermediate sections or segments II is effected in all cases by means of spikes 11 extending from their rear faces, and fittings in the unit and the frame, the latter consisting of the aforementioned bushings 14.

In the case of one sole unit consisting of a switch, which is what is illustrated in the aforementioned FIGS. 15, 16 and 17, the central section is affixed to the part b' of the unit by means of which the corresponding movable contact is activated, and the other two directly to the frame; in the case of two switches, the central section is affixed to the frame and each of the other two to the part b' of the switches; in the case of three switches, each of the sections is affixed to the part b' of one of the switches; in the case of one, two or three sockets, all of them are affixed to the frame, and in any combination of switch and socket, the section corresponding to the switch is affixed to the part b' of the switch and the section corresponding to the socket directly to the frame.

With regard to other possible variations of the invention it should be noted that the headboards I may be immovably affixed to the frame, which is a separate part as regards them; for instance they can be two parts cast directly on to the ends of the frame.

Another possible variation consists of making one sole part of the headboards and the frame by any of the accepted technical procedures for example, casting, stamping, etc.

When this invention is put into practice, undoubtedly some modifications can be introduced as regards certain details of construction and shape of the cover for boxes housing electric contact units, such as switches, push buttons, sockets or similar invented units, but always provided that they do not depart from the fundamental principles clearly specified in the claims which follow.

Having thus specially described and determined the nature and scope of the present invention and the manner in which it has to be carried out, the following is claimed as of exclusive property and right:

1. For use in combination with a conventional electric box or housing within which one or more receptacles each having electric contacts is contained, an improved universal cover assembly for the box and the one or more receptacles, said cover assembly comprising: a generally flat, uniplanar, rectangular frame surrounding the conventional box, said frame having a central rectangular opening defined therethrough; a series of removable, rectangular, individual cover plates, each being detachably mounted on said frame, said series of cover plates being arranged transversely across and entirely covering said frame and having outer, flat planar surfaces all aligned in substantially the same plane, said series of cover plates including an upper and lower headboard cover plate detachably mounted to the upper and lower portions of the rectangular frame, the lower end of the upper headboard plate abutting the upper end of the frame rectangular opening and the upper end of the lower headboard plate abutting the lower end of the frame rectangular opening, and at least two, selectively interchangeable intermediate plates arranged between the headboard plates; a series of paired recess means arranged along each vertical side of said frame; pin means on the inner sides of said upper and lower headboard plates for friction fit engagement in the uppermost and lowermost of said paired recess means in said frame, respectively; pin means on the inner side of one of said interchangeable plates for friction fit engagement with paired recess means intermediate of said uppermost and lowermost paired recess means; and pins means on the inner side of the other of said interchangeable plates for friction fit engagement with a receptacle located in the box, said one or said other of said intermediate plates being selected for use in said assembly depending upon the type of receptacle to be located within the box.

2. The cover assembly as claimed in claim 1 wherein the receptacle is a switch with an actuator therefor and said other interchangeable intermediate plate pins are directly inserted into the receptacle actuator.

3. The cover assembly as claimed in claim 1 wherein the receptacle is a socket having contact connections, said one interchangeable, intermediate plate having openings therethrough aligned with said sockets when said one intermediate plate is attached to said frame.

4. The cover assembly as claimed in claim 1 wherein multiples of said one intermediate cover and multiples of said other intermediate cover are provided for selective use with said cover assembly depending on the type and number of receptacles contained in the box.

5. For use in combination with a conventional electric box or housing within which one or more receptacles each having electric contacts is contained, an improved universal cover assembly for the box and the one or more receptacles, said cover assembly comprising: a generally flat, uniplanar, rectangular frame surrounding the conventional box, said frame having a central rectangular opening defined therethrough; a series of removable, rectangular, individual cover plates, each being detachably mounted on said frame, said series of cover plates being arranged transversely across and entirely covering said frame and having outer, flat planar surfaces all aligned in substantially the same plane, said series of cover plates including an upper and a lower headboard cover plate detachably mounted to the upper and lower portions of the rectangular frame, the lower end of the upper headboard plate abutting the upper end of the frame rectangular opening and the upper end of the lower headboard plate abutting the lower end of the frame rectangular opening, and at least one intermediate plate arranged between the headboard plates; a series of paired recess means arranged along each vertical side of said frame; pin means on the inner sides of said upper and lower headboard plates for friction fit engagement in the uppermost and lowermost of said paired recess means in said frame, respectively; and pin means on the inner side of said intermediate plate for friction fit engagement with paired recess means intermediate of said uppermost and lowermost paired recess means.

6. The cover assembly as claimed in claim 5 wherein the receptacle is a socket having contact connections, said intermediate plate having openings therethrough aligned with said sockets.

7. For use in combination with a conventional electric box or housing within which one or more receptacles each having electric contacts is contained, an improved universal cover assembly for the box and the one or more receptacles, said cover assembly comprising: a generally flat, uniplanar, rectangular frame surrounding the conventional box, said frame having a central rectangular opening defined therethrough; a series of removable, rectangular, individual cover plates, each being detachably mounted on said frame, said series of cover plates being arranged transversely across and entirely covering said frame and having outer, flat planar surfaces all aligned in substantially the same plane, said series of cover plates including an upper and a lower headboard cover plate detachably mounted to the upper and lower portions of the rectangular frame, the lower end of the upper headboard plate abutting the upper end of the frame rectangular opening and the upper end of the lower headboard plate abutting the lower end of the frame rectangular opening, and at least one intermediate plate arranged between the headboard plates; a series of paired recess means arranged along each vertical side of said frame; pin means on the inner sides of said upper and lower headboard plates for friction fit engagement in the uppermost and lowermost of said paired recess means in said frame, respectively; and pin means on the inner side of said intermediate plate for friction fit engagement with a receptacle located in the box.

8. The cover assembly as claimed in claim 7 wherein the receptacle is a switch with an actuator therefor and said intermediate plate pins are directly inserted into the receptacle actuator.

9. The cover assembly as claimed in claims 5 or 7 wherein there are at least two of said intermediate plates.

10. The cover assembly as claimed in claims 1, 5 or 7 wherein there are at least three of said intermediate plates.

11. The cover assembly as claimed in claims 1, 5 or 7 wherein the length and width dimensions of the headboard plates and the intermediate plates are identical.

12. The cover assembly as claimed in claims 1, 5 or 7 further comprising means in said frame for mounting one or more receptacles behind the frame for location in the box.

* * * * *